United States Patent [19]

Staples

[11] Patent Number: 4,943,696

[45] Date of Patent: Jul. 24, 1990

[54] DIAPHRAGM TYPE SWITCH

[75] Inventor: Paul R. Staples, Cub Run, Ky.

[73] Assignee: E. M. B. Corporation, Elizabethtown, Ky.

[21] Appl. No.: 302,927

[22] Filed: Jan. 30, 1989

[51] Int. Cl.[5] ..... H01H 5/20

[52] U.S. Cl. ..... 200/407; 200/335; 200/441; 200/302.1

[58] Field of Search ..... 200/407, 412, 510, 513, 200/516, 517, 520, 557, 559, 440, 441, 245, 246, 247, 284, 302.1, 302.2, 332, 333, 335, 339

[56] References Cited

U.S. PATENT DOCUMENTS

| | | | |
|---|---|---|---|
| 3,094,594 | 6/1963 | Watson | 200/302.2 |
| 3,339,048 | 8/1967 | Haderer | 200/407 |
| 4,105,882 | 8/1978 | Ulbing et al. | 200/302.3 |
| 4,328,406 | 5/1982 | Evans et al. | 200/284 |
| 4,482,791 | 11/1984 | Rendgen | 200/302.2 |
| 4,587,387 | 5/1986 | Piguet | 200/407 |

FOREIGN PATENT DOCUMENTS

| | | | |
|---|---|---|---|
| 6511143 | 4/1966 | Netherlands | 200/302.3 |

*Primary Examiner*—Henry J. Recla
*Assistant Examiner*—Glenn T. Barrett
*Attorney, Agent, or Firm*—Robert F. Meyer

[57] ABSTRACT

A snap switch is enclosed in a cup shaped housing with an open end. The open end is closed by a diaphragm. The snap action of the switch is provided through a member which has a reactor member and two reaction members which are formed by providing parallel slots in a contact blade. The switch is actuated by a switch actuator which is mounted on the cup shaped housing to provide circular lever pivoting of the actuator.

6 Claims, 2 Drawing Sheets

DIAPHRAGM TYPE SWITCH

BACKGROUND OF THE INVENTION

This invention relates to a switch and more particularly to a sealed electrical power switch that is useful in the electrical appliance industry.

In many consumer products that utilize electrical power to accomplish a desired result, the electrical power switching function requirements are adversely affected by the switch's environment. Premature failure of the switch can and does result from the presence of contaminants in the electrical contacts area. Dust, dirt, oil, moisture and water are some of an electrical switch's enemies.

In a clothes washing appliance for example an access lid integrates an actuator of an electrical switch which interrupts the motor circuit when the lid is opened. Because of the electrical switch location on the underside of the machine top, water and washing chemicals come into contact with the electrical terminals of the switch, causing switch failure.

One of the best ways to provide a switch that is protected from the environment is to utilize a diaphragm actuated switch. In the present switch a diaphragm switch is used to provide a nap action. Such snap action aids in preventing arcing between electrical contacts.

SUMMARY OF THE INVENTION

In accordance with the present invention there is provided a diaphragm switch which in general comprises a cup shaped housing having an open end and a flexible diaphragm closing the open end; a fixed electrical terminal blade having-an electrical contact carried in the cup shaped housing; a movable electrical terminal blade having an electrical contact carried in the cup shaped housing opposite the fixed electrical terminal blade and in working relation therewith; the movable terminal blade including a body portion, two opposed slots running lengthwise in the body portion providing a centrally disposed reactor member and a pair of outer reaction members: and a pair of oppositely disposed seats carried in the cup shaped member against which the reaction members are biased.

In addition there is a mounting means carried by the cup shaped member for a switch actuator which provides circular lever pivoting of the switch actuator.

DETAILED DESCRIPTION OF THE INVENTION

Figure 1:
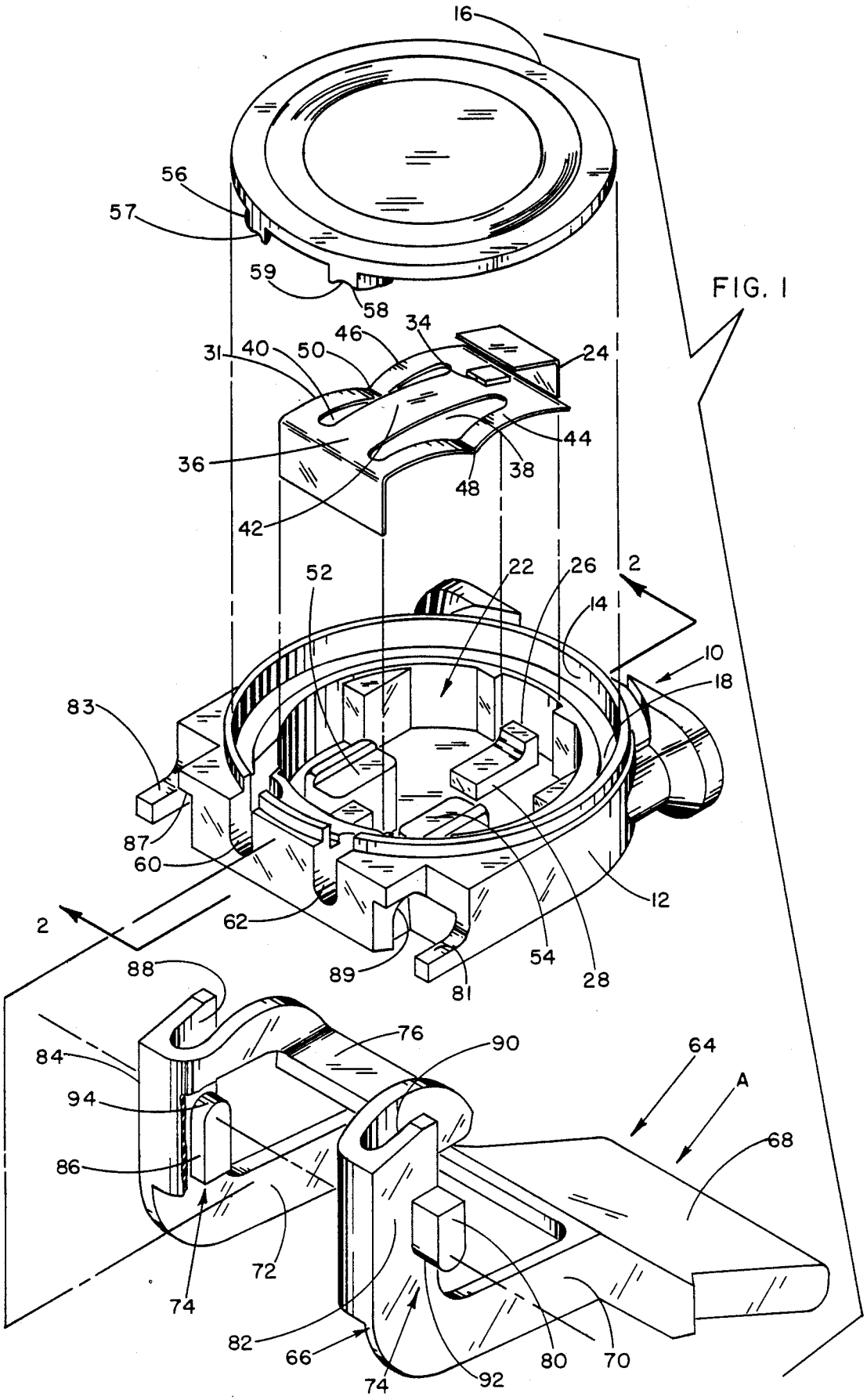
FIG. 1 is an exPloded view of a diaphragm type switch illustrating the invention.

Referring now to the drawings there is shown a diaphragm type switch 10 embodying the invention. Switch 10, in general, includes a cup shaped housing 12 having an open end 14 that is closed by a diaphragm 16. Diaphragm 18 may be made of a suitable elastomer. As more clearly shown in FIGS. 2 and 3, the diaphragm is clinched into annular groove 18 by heating wall 20 and folding it inwardly. Thus a sealed switch chamber 22 is provided to protect the switch from its outside environment.

A fixed electrical terminal blade 24 is carried in an annular slot 26 formed by a wall of cup shaped housing 12 and a seat 28. An electrical contact 30 is carried by the terminal blade. A movable electrical terminal blade 31 is carried in slot 32. An electrical contact 34 is carried by the terminal blade. Both the terminals and the electrical contacts are fabricated of a good electrically conductive material such as copper.

Movable electrical terminal blade 31 is constructed in such a manner as to provide a snap action to the switch. Such snap action acts to prevent spurious arcing between the electrical contacts 30 and 34. As best shown in FIG. 1, movable electrical contact terminal blade 31 includes a body position 36 having two parallel slots 38 and 40 running lengthwise along the body portion. The slots provide a centrally disposed strip 42 serving as a reactor member and a pair of outer strips 44 and 46 at the outer rims of the terminal body that serve as reaction members. The outer reaction members are depressed to be spring loaded near their center positions 48 and 50. The outer reaction members rest upon seats 52 and 54 to be biased against the seats.

Electrical lead wires (not shown) may be connected to the terminal blades in a suitable manner known in the art. The lead wires can then be individually fed through apertures formed by the intermeshing of lugs 56 and 58 of diaphragm 16 into slots 60 and 62 provided in cup shaped housing 12. The lugs have curved ends 57 and 59 and would be fitted into the slots so as to form a tight fit on the lead wires.

Switch 10 is actuated by switch actuator means 64. Switch actuator means includes a cradle 66 having a flat base portion 68, legs 70 and 72, and pivot means 74. A cross bar 76 adds structural rigidity to legs 70 and 72 and permits them to act as a unit as well as provide a means for transmitting a load to diaphragm 16. Pivot means 74 includes a lug 80 extending from an outer surface 82 of leg 70, a similar lug (not shown) extending from outer surface 84 of leg 72, a lug 86 extending from inner surface 88 and a similar lug (not shown) extending from inner surface 90 of lug 70. Lug 80 extending from outer surface 82 and its counterpart which extends from outer surface 84 have radiused ends 92 pointed in one direction; while lug 86 extending from inner surface 88 and its counterpart extending from inner surface 90 have radiused ends 94 pointed in the opposite direction. Lug 80 and its counterpart pivots against surfaces 81 and 83 while lug 86 and its counterpart pivots against surfaces 87 and 89. This arrangement provides circular lever pivoting of the actuator.

Figure 2:
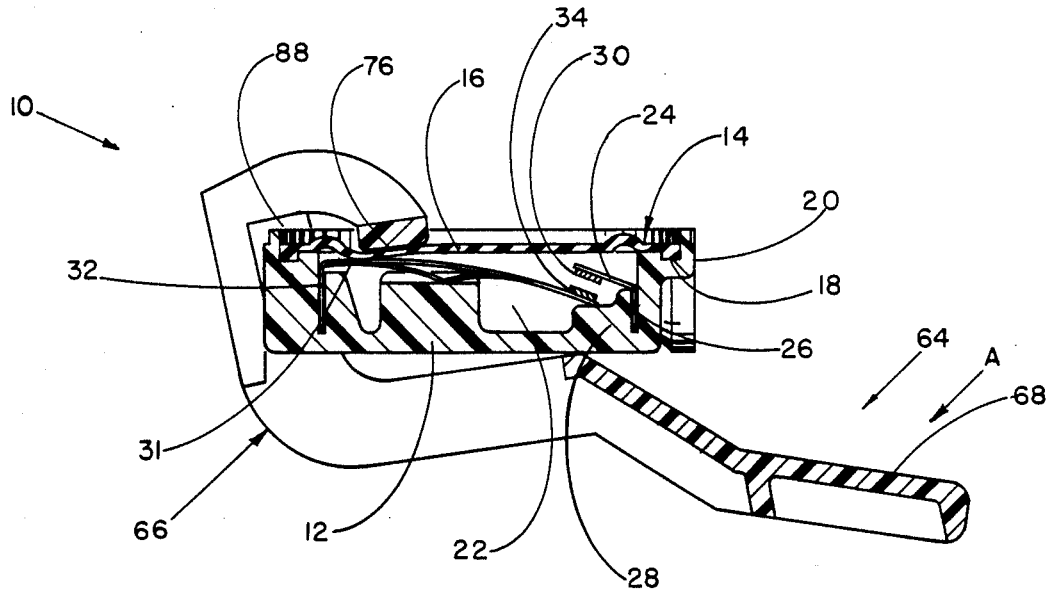
FIGS. 2 and 3 are cross sections taken along the line 2—2 of FIG. 1 showing the switches in different operating positions.
Figure 3:
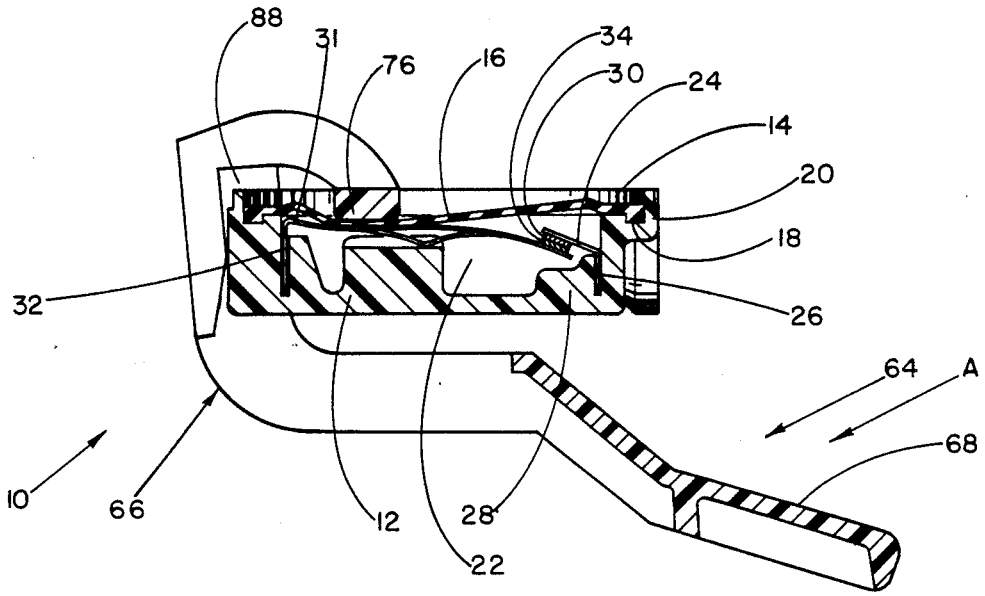

The operation of the switch can be described with reference to FIG. 2 and 3. In FIG. 2 the switch is in a relaxed position and contacts 30 and 34 are open. When as shown in FIG. 3, a force is applied in the direction of arrow A against base portion 68 a circular lever pivoting of cradle 66 is achieved such that cross bar 76 engages diaphragm 16 to depress it and cause actuation of switch 10. More specifically reactor member 42 is depressed causing it and reaction members 44 and 46 to flatten out such that contact 34 engages contact 30 to close the switch. The switch closes with a snap action because of the action of the reaction members 44 and 46.

What is claimed is:

1. A switch comprising:

a cup shaped housing having an open end and a flexible diaphragm closing said open end, lugs extending from said flexible diaphragm, and slots in said cup shaped housing receiving said lugs to which together form apertures through said housing through which lead wires for said switch can be fed, a fixed electrical terminal blade having an electrical contact and carried in said cup shaped housing, a movable electrical contact blade having an electrical contact carried in said cup shaped housing opposite said fixed electrical terminal blade and in working relation therewith, said movable terminal blade including a body portion, two opposed slots running lengthwise in said body portion providing a centrally disposed reactor member and a pair of outer reaction members, a pair of oppositely disposed seats carried in said cup shaped housing against which said reaction members are biased.

2. A switch according to claim 1 wherein said cup shaped member includes slots in which said fixed and movable electrical terminal blades are individually carried.

3. A switch according to claim 1 further including an actuator and pivot means providing circular lever pivoting of said actuator on said cup shaped housing.

4. A switch according to claim 3 wherein said actuator is a cradle having a pair of legs each of which is pivotally mounted on said cup shaped housing and a cross bar extending between said pair of legs, said cross bar selectively engaging said diaphragm.

5. A switch according to claim 4 wherein said pivot means includes a first pair of lugs each of which is carried on an inner surface of each leg of said opposed pair of legs and having radiused ends pointed in a first direction, a second pair of lugs one each carried on an outer surface of each leg of said pair of legs and having radiused ends pointed a second direction opposite said first direction, and cooperating surfaces on said cup shaped housing against which said first and second pair of lugs pivot.

6. A switch comprising:

a cup shaped housing having an open end and a flexible diaphragm closing said open end, switch means carried in said cup shaped housing and actuated through said flexible diaphragm, and a switch actuator including a pair of opposed legs, pivot means mounting each one of said pair of opposed legs on said cup shaped housing and a cross bar extending therebetween and selectively engaging said diaphragm, said pivot means including a first pair of lugs each of which is carried on an inner surface of each leg of said pair of legs and having radiused ends pointed in a first direction, a second pair of lugs each of which is carried on an outer surface of each leg of said pair of legs and having radiused ends pointed in a second direction opposite said first direction, and cooperating surfaces on said cup shaped housing against which said first and second pair of lugs pivot.

* * * * *